US005873668A

United States Patent [19]

Annoni

[11] Patent Number: 5,873,668

[45] Date of Patent: Feb. 23, 1999

[54] WRITING INSTRUMENT ATTACHMENT

[76] Inventor: John F. Annoni, 526 N. Saint George, Allentown, Pa. 18104

[21] Appl. No.: 86,456

[22] Filed: May 28, 1997

[51] Int. Cl.[6] ..... B43K 23/00

[52] U.S. Cl. ..... 401/89; 401/88

[58] Field of Search ..... 401/89, 88, 90, 401/92

[56] References Cited

U.S. PATENT DOCUMENTS

| | | | |
|---|---|---|---|
| 2,483,103 | 9/1949 | Raimondi | 401/90 |
| 3,076,437 | 2/1963 | Johnson | 401/89 |
| 4,408,921 | 10/1983 | Nagai | 401/89 |

*Primary Examiner*—David J. Walczak

[57] ABSTRACT

A new writing instrument attachment for attaching to a common writing instrument. The inventive device includes a case having opposite first and second ends, The first end of the case has a first bore therein and the second end of the case has a second bore therein. The second bore is designed for receiving a writing tip of a writing instrument therein. A receiving member is inserted into the first bore such that a hole provided in the receiving member faces away from the first end of the case. One end of an insert member is inserted in the hole of the receiving member. The other end of the insert member has a generally cylindrical marking compound outwardly extending therefrom. The marking compound is designed for making a mark on a writing surface.

10 Claims, 2 Drawing Sheets

WRITING INSTRUMENT ATTACHMENT

BACKGROUND OF THE INVENTION

1. Field of the Invention

The present invention relates to pencils and other writing instrument attachments and more particularly pertains to a new writing instrument attachment for attaching to a common writing instrument.

2. Description of the Prior Art

The use of pencils and other writing instrument attachments is known in the prior art. More specifically, pencils and other writing instrument attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art pencils and other writing instrument attachments include U.S. Pat. No. 4,580,918; U.S. Pat. No. 5,292,202; U.S. Pat. No. 4,390,299; U.S. Pat. No. 4,957,384; U.S. Pat. No. 4,301,121; and U.S. Pat. No. Des. 353,621.

While these devices fulfill their respective, particular objectives and requirements, the aforementioned patents do not disclose a new writing instrument attachment. The inventive device includes a case having opposite first and second ends, The first end of the case has a first bore therein and the second end of the case has a second bore therein. The second bore is designed for receiving a writing tip of a writing instrument therein. A receiving member is inserted into the first bore such that a hole provided in the receiving member faces away from the first end of the case. One end of an insert member is inserted in the hole of the receiving member. The other end of the insert member has a generally cylindrical marking compound outwardly extending therefrom. The marking compound is designed for making a mark on a writing surface.

In these respects, the writing instrument attachment according to the present invention substantially departs from the conventional concepts and designs of the prior art, and in so doing provides an apparatus primarily developed for the purpose of attaching to a common writing instrument.

SUMMARY OF THE INVENTION

In view of the foregoing disadvantages inherent in the known types of pencils and other writing instrument attachments now present in the prior art, the present invention provides a new writing instrument attachment construction wherein the same can be utilized for attaching to a common writing instrument.

The general purpose of the present invention, which will be described subsequently in greater detail, is to provide a new writing instrument attachment apparatus and method which has many of the advantages of the pencils and other writing instrument attachments mentioned heretofore and many novel features that result in a new writing instrument attachment which is not anticipated, rendered obvious, suggested, or even implied by any of the prior art pencils and other writing instrument attachments, either alone or in any combination thereof.

To attain this, the present invention generally comprises a case having opposite first and second ends, The first end of the case has a first bore therein and the second end of the case has a second bore therein. The second bore is designed for receiving a writing tip of a writing instrument therein. A receiving member is inserted into the first bore such that a hole provided in the receiving member faces away from the first end of the case. One end of an insert member is inserted in the hole of the receiving member. The other end of the insert member has a generally cylindrical marking compound outwardly extending therefrom. The marking compound is designed for making a mark on a writing surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new writing instrument attachment apparatus and method which has many of the advantages of the pencils and other writing instrument attachments mentioned heretofore and many novel features that result in a new writing instrument attachment which is not anticipated, rendered obvious, suggested, or even implied by any of the prior art pencils and other writing instrument attachments, either alone or in any combination thereof.

It is another object of the present invention to provide a new writing instrument attachment which may be easily and efficiently manufactured and marketed.

It is a further object of the present invention to provide a new writing instrument attachment which is of a durable and reliable construction.

An even further object of the present invention is to provide a new writing instrument attachment which is susceptible of a low cost of manufacture with regard to both materials and labor, and which accordingly is then susceptible of low prices of sale to the consuming public, thereby making such writing instrument attachment economically available to the buying public.

Still yet another object of the present invention is to provide a new writing instrument attachment which provides in the apparatuses and methods of the prior art some of the advantages thereof, while simultaneously overcoming some of the disadvantages normally associated therewith.

Still another object of the present invention is to provide a new writing instrument attachment for attaching to a common writing instrument.

Yet another object of the present invention is to provide a new writing instrument attachment which includes a case having opposite first and second ends, The first end of the case has a first bore therein and the second end of the case has a second bore therein. The second bore is designed for receiving a writing tip of a writing instrument therein. A receiving member is inserted into the first bore such that a hole provided in the receiving member faces away from the first end of the case. One end of an insert member is inserted in the hole of the receiving member. The other end of the insert member has a generally cylindrical marking compound outwardly extending therefrom. The marking compound is designed for making a mark on a writing surface.

Still yet another object of the present invention is to provide a new writing instrument attachment that provides a marking compound (more commonly known as a writing pencil lead) having a greater writing surface area than a sharpened pencil for permitting faster filling in of grids or spaces such as the type found on standardized tests (including computer graded answer sheets).

Even still another object of the present invention is to provide a new writing instrument attachment that may be used on its own without attachment to a common writing instrument.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
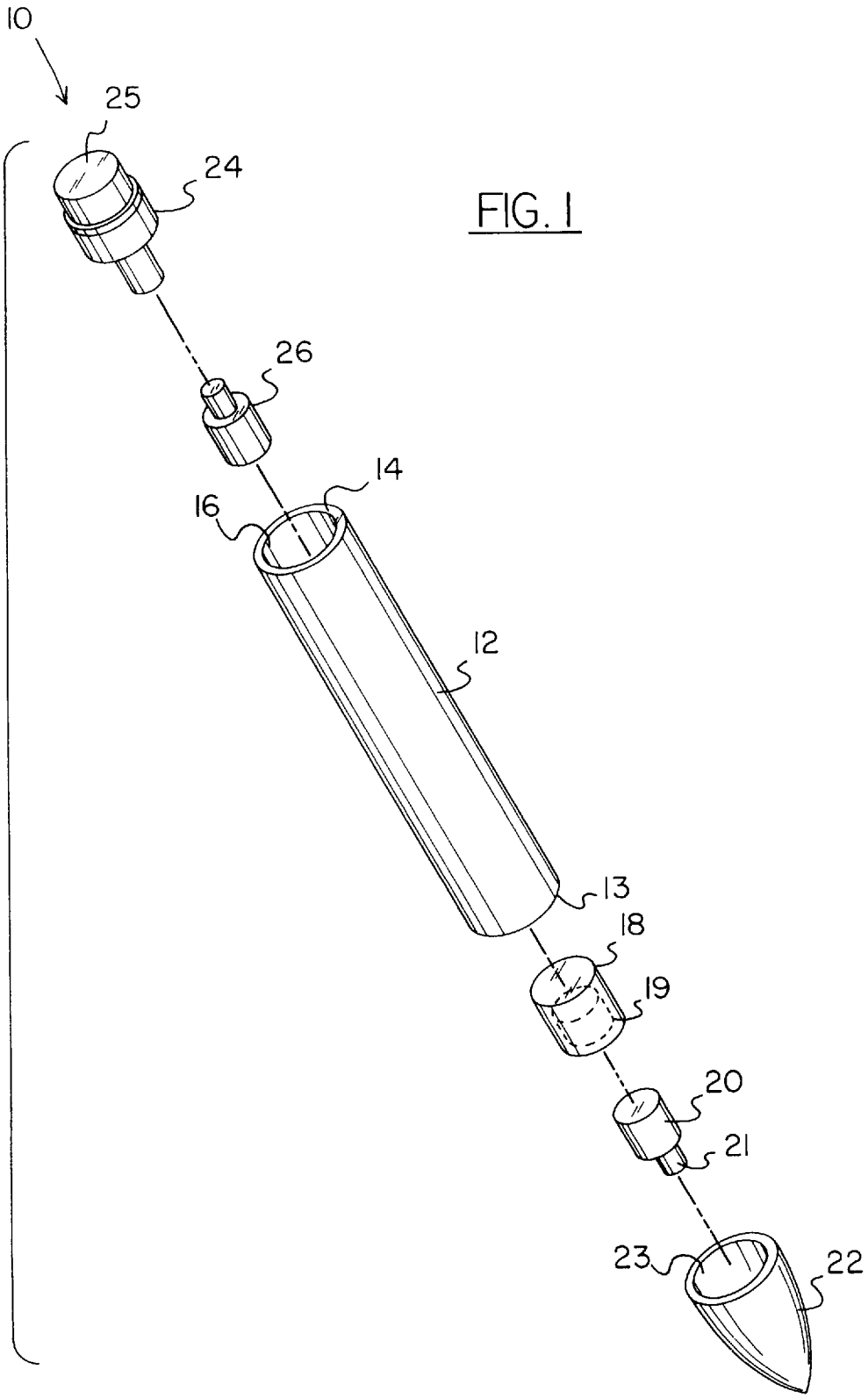
FIG. 1 is a schematic exploded perspective view of a new writing instrument attachment according to the present invention.
Figure 2:
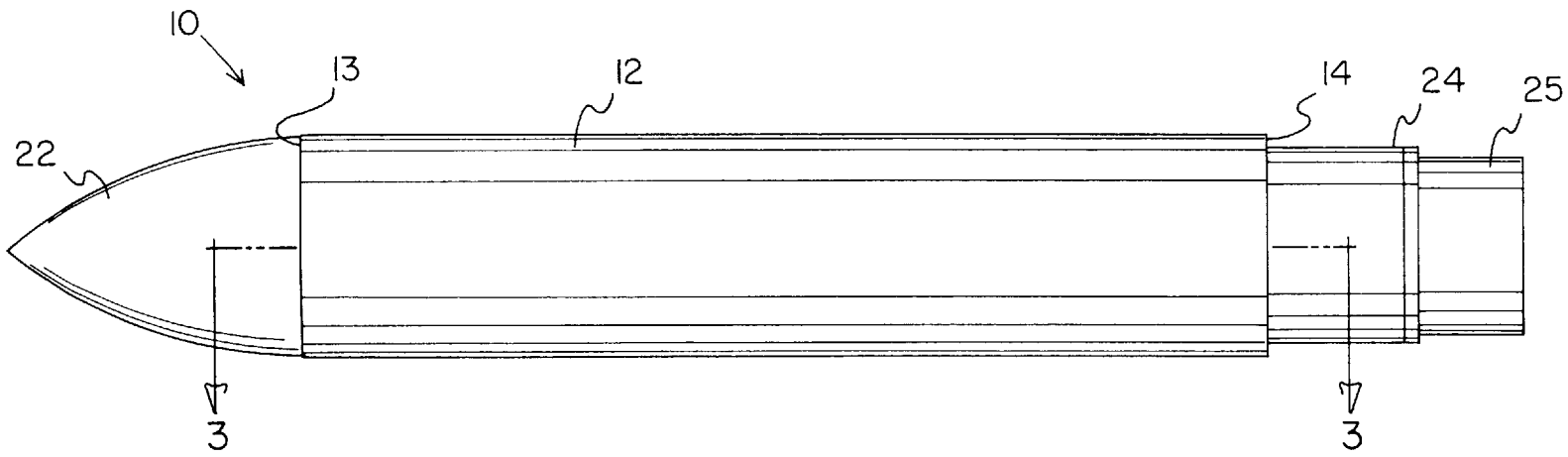
FIG. 2 is a schematic side view of the present invention.
Figure 3:
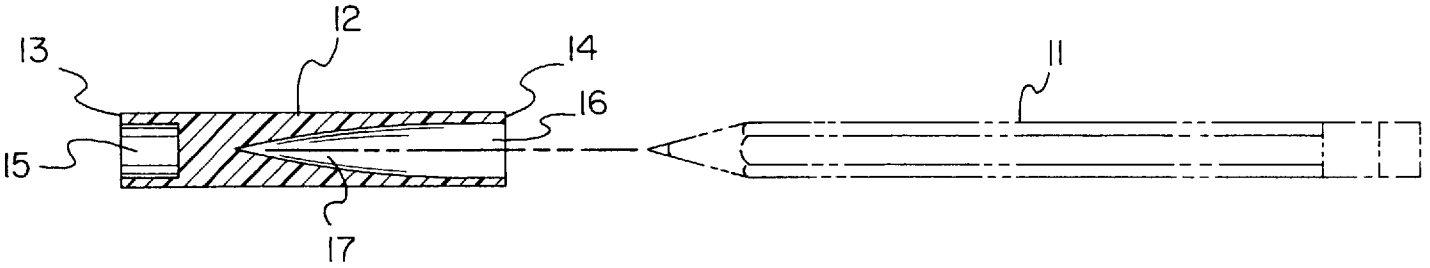
FIG. 3 is a schematic sectional view of the present invention as seen from line 3—3 of FIG. 2 illustrating a pencil being inserted into the second bore of the case.

With reference now to the drawings, and in particular to FIGS. 1 through 3 thereof, a new writing instrument attachment embodying the principles and concepts of the present invention and generally designated by the reference numeral 10 will be described.

As best illustrated in FIGS. 1 through 3, the writing instrument attachment 10 generally comprises a case 12 having opposite first and second ends 13,14, The first end 13 of the case 12 has a first bore 15 therein and the second end 14 of the case 12 has a second bore 16 therein. The second bore 16 is designed for receiving a writing tip of a writing instrument 11 therein. A receiving member 18 is inserted into the first bore 15 such that a hole 19 provided in the receiving member 18 faces away from the first end 13 of the case 12. One end of an insert member 20 is inserted in the hole 19 of the receiving member 18. The other end of the insert member 20 has a generally cylindrical marking compound 21 outwardly extending therefrom. The marking compound 21 is designed for making a mark on a writing surface.

In use, the writing instrument attachment is designed for attaching to a writing end of a writing instrument such as a pencil 11 as illustrated in FIG. 3, The writing instrument attachment 10 provides a marking compound 21 (more commonly known as a writing pencil lead, although an ink based compound may also optionally be used) having a greater writing surface area than a sharpened pencil for permitting faster filling in of grids or spaces such as the type found on standardized tests (including computer graded answer sheets). The writing instrument attachment 10 may also be used on its own without attachment to a common writing instrument.

In closer detail, the case 12 is preferably generally cylindrical and has opposite first and second ends 13,14. The first end 13 of the case 12 has a first bore 15 therein. The first bore 15 is generally cylindrical and preferably the axis of the first bore is generally coaxial with the longitudinal axis of the case 12. The second end 14 of the case 12 has a second bore 16 therein. The second bore 16 is generally cylindrical with a conical end portion 17 tapering towards the first end 13 of the case 12. Preferably, the axis of the second bore 16 is also coaxial with the longitudinal axis of the case 12. The second bore 16 is designed for receiving a writing tip of a writing instrument therein. Optionally, when not receiving a writing instrument therein, the second bore may be used to store an additional insert member 26 therein as illustrated in FIG. 1.

The receiving member 18 is preferably generally cylindrical and has a generally cylindrical hole 19 therein. The receiving member 18 is removably inserted into the first bore 15 such that the hole 19 of the receiving member 18 faces away from the first end 13 of the case 12. One end of a generally cylindrical insert member 20 is removably inserted in the hole 19 of the receiving member 18. The other end of the insert member 20 has a generally cylindrical marking compound 21 outwardly extending therefrom. The marking compound 21 has a generally circular end for aiding the quick filling in of spaces or grids on a sheet of paper such as on a computer graded standardized test answer sheet. Preferably, the marking compound 21 comprises graphite (that is, the material commonly known as pencil lead). Ideally, the insert member is inserted into the hole of the receiving member so that the marking compound 21 is coaxial with the longitudinal axis of the case 12.

Preferably, a generally conical first end cap 22 is provided to substantially cover the receiving member and the insert member extending from the first end of the case. The first end cap 22 has a circular base end which has an opening 23 therein. The receiving member 18 and the insert member 20 are inserted into the opening 23 of the first end cap 22 such that the first end cap 22 substantially covers the portions of the receiving member 18 and insert member 20 extending from the first end 13 of the case 12. Ideally, the diameter of the base end of the first end cap 22 is about equal to the diameter of the case 12.

Also preferably, a second end cap 24 is removably inserted into the second bore 16 of the case 12 such that the second end cap 24 substantially closes the second bore 16 of the case 12. Preferably, the second end cap 24 has an eraser 25 coupled thereto for erasing marks made by the marking compound 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A writing instrument attachment for attaching to an end of a writing instrument, said attachment comprising:

a case having opposite first and second ends;

said first end of said case having a first bore therein;

said second end of said case having a second bore therein, said second bore being for receiving a writing tip of a writing instrument therein;

a receiving member having a hole therein, said receiving member being inserted into said first bore such that said hole of said receiving member faces away from said first end of said case;

an insert member having a pair of opposite ends;

one of said ends of said insert member having a generally cylindrical marking compound outwardly extending therefrom, said marking compound being for making a mark on a writing surface;

another of said ends of said insert member being inserted in said hole of said receiving members;

wherein said case is generally cylindrical:

wherein said first bore is generally cylindrical:

said first bore having a generally circular closed end wall and a generally cylindrical side wall extending between said closed end wall of said first bore and said first end of said case;

wherein said second bore is generally cylindrical, wherein said second bore has a conical end portion tapering towards said first end of said case to a closed vertex between said closed end wall of said first bore and said second end of said case; and said closed vertex of said conical end portion being spaced apart a distance from said closed end wall of said first bore such that passage between the first and second bores is blocked by an interior region of said case.

2. The attachment of claim 1, wherein said marking compound comprises graphite.

3. The attachment of claim 1, further comprising a first end cap having base end, said base end of said first end cap having an opening therein, said receiving member and said insert member being inserted into said opening of said first end cap such that said first end cap substantially covers said receiving member and insert. member.

4. The attachment of claim 1, further comprising an end cap being inserted into said second bore of said case such that said second end cap substantially closes said second bore of said case.

5. The attachment of claim 4, wherein said second end cap has an eraser coupled thereto.

6. A writing instrument attachment for attaching to an end of a writing instrument, said attachment comprising:

a case being generally cylindrical and having a longitudinal axis, and opposite first and second ends;

said first end of said case having a first bore therein, said first bore being generally cylindrical and having an axis, wherein said axis of said first bore is generally coaxial with said longitudinal axis of said case;

said first bore having a generally circular closed end wall and a generally cylindrical side wall extending between said closed end wall of said first bore and said first end of said case:

said closed end wall of said first wall being substantially planar and lying in a plane extending generally perpendicular to said longitudinal axis of said case, said side wall of said first bore being generally coaxial with said longitudinal axis of said case:

said second end of said case having a second bore therein, said second bore being generally cylindrical and having [a] an axis, wherein said axis of said second bore is coaxial with said longitudinal axis of said case;

said second bore having a conical end portion tapering towards said first end of said case to a closed vertex between said closed end wall of said first bore and said second end of said case, said closed vertex of said conical portion being located on said longitudinal axis of said case;

said closed vertex of said conical end portion being spaced apart a distance from said closed end wall of said first bore such that passage between the first and second bores is blocked by an interior region of said case:

a receiving member being generally cylindrical and having a diameter and a hole therein, said receiving member being inserted into said first bore such that said hole of said receiving member faces away from said first end of said case;

an insert member being generally cylindrical and having a pair of opposite ends;

one of said ends of said insert member having a generally cylindrical marking compound outwardly extending therefrom, wherein said marking compound comprises graphite;

another of said ends of said insert member being inserted in said hole of said receiving member;

said another of said ends of said insert member being closed to prevent extension therethrough of said marking compound;

a first end cap being generally conical and having a circular base end, said base end of said first end cap having an opening therein, said receiving member and said insert member being inserted into said opening of said first end cap such that said first end cap substantially covers said receiving member and insert member;

said first end cap tapering to a pointed closed tip distal said base end of said first end cap;

a second end cap being inserted into said second bore of said case such that said second end cap substantially closes said second bore of said case, said second end cap having an eraser coupled thereto;

said first bore having a length defined along said longitudinal axis of said case between said closed end wall of said first bore and said first end of said case; and wherein said distance between said closed end wall of said first bore and said closed vertex of said conical portion of said second bore are spaced apart is about equal to said length of said first bore.

7. The writing instrument attachment of claim 1, wherein said case has a longitudinal axis extending between said first and second ends of said case, and wherein said closed end wall of said first wall is substantially planar and lies in a plane extending generally perpendicular to said longitudinal axis of said case, said side wall of said first bore being generally coaxial with said longitudinal axis of said case.

8. The writing instrument attachment of claim 1, wherein said another of said ends of said insert member being closed to prevent extension therethrough of said marking compound.

9. The writing instrument attachment of claim 1, wherein said first bore has a length defined along said longitudinal axis of said case between said closed end wall of said first bore and said first end of said case, and wherein said distance between said closed end wall of said first bore and said closed vertex of said conical portion of said second bore are spaced apart is about equal to said length of said first bore.

10. In combination:

a case being generally cylindrical and having a longitudinal axis, and opposite first and second ends;

said first end of said case having a first bore therein, said first bore being generally cylindrical and having an axis, wherein said axis of said first bore is generally coaxial with said longitudinal axis of said case;

said first bore having a generally circular closed end wall and a generally cylindrical side wall extending between said closed end wall of said first bore and said first end of said case;

said closed end wall of said first wall being substantially planar and lying in a plane extending generally perpendicular to said longitudinal axis of said case, said side wall of said first bore being generally coaxial with said longitudinal axis of said case;

said second end of said case having a second bore therein, said second bore being generally cylindrical and having an axis, wherein said axis of said second bore is coaxial with said longitudinal axis of said case;

said second bore having a conical end portion tapering towards said first end of said case to a closed vertex between said closed end wall of said first bore and said second end of said case;

said closed vertex of said conical end portion being spaced apart a distance from said closed end wall of said first bore such that passage between the first and second bores is blocked by an interior region of said case;

a receiving member being generally cylindrical and having a diameter and a hole therein, said receiving member being inserted into said first bore such that said hole of said receiving member faces away from said first end of said case;

an insert member being generally cylindrical and having a pair of opposite ends;

one of said ends of said insert member having a generally cylindrical marking compound outwardly extending therefrom, wherein said marking compound comprises graphite;

another of said ends of said insert member being inserted in said hole of said receiving member;

said another of said ends of said insert member being closed to prevent extension therethrough of said marking compound;

a first end cap being generally conical and having a circular base end, said base end of said first end cap having an opening therein, said receiving member and said insert member being inserted into said opening of said first end cap such that said first end cap substantially covers said receiving member and insert member;

said first end cap tapering to a pointed closed tip distal said base end of said first end cap;

said first bore having a length defined along said longitudinal axis of said case between said closed end wall of said first bore and said first end of said case;

wherein said distance between said closed end wall of said first bore and said closed vertex of said conical portion of said second bore are spaced apart is about equal to said length of said first bore; and a writing instrument having a generally conical tapered writing tip, said tapered writing tip being inserted into said second bore through said second end of said case.

* * * * *